United States Patent [19]

Stutzman

[11] 4,382,400

[45] May 10, 1983

[54] COMBINED CEILING MOUNTED FAN AND LIGHTING FIXTURE

[76] Inventor: Clarence Stutzman, 1429 Reedsburg North, Wooster, Ohio 44691

[21] Appl. No.: 223,587

[22] Filed: Jan. 9, 1981

[51] Int. Cl.[3] ..... F24F 7/00

[52] U.S. Cl. ..... 98/40 DL; 362/294; 416/5

[58] Field of Search ..... 98/40 DL; 362/294; 416/5, 170 R; 310/261, 264, 265, 68 R, 68 B

[56] References Cited

U.S. PATENT DOCUMENTS

| | | | |
|---|---|---|---|
| 585,250 | 6/1897 | Bennett, Jr. . | |
| 591,033 | 10/1897 | Collins | 416/5 |
| 623,801 | 4/1899 | Melzer . | |
| 2,079,942 | 5/1937 | Levelle . | |
| 2,119,398 | 5/1938 | Morse . | |
| 2,201,153 | 5/1940 | Brown . | |
| 2,547,896 | 4/1951 | Wellen . | |
| 2,581,185 | 1/1952 | Gordon . | |
| 2,741,695 | 4/1956 | Schockett | 362/294 |
| 4,064,427 | 12/1977 | Hansen et al. | 362/96 |
| 4,073,598 | 2/1978 | Mizutani et al. | 416/5 |

*Primary Examiner*—William E. Tapolcai

*Attorney, Agent, or Firm*—Hamilton, Renner & Kenner

[57] ABSTRACT

A compact, combined ceiling mounted fan and lighting fixture (10) that eliminates flicker effect and provides soft, indirect lighting includes a housing (11) capable of being mounted to the ceiling, a fan motor (12) for rotating the fan blades (15) and mounted within housing (11), a light source (13) for generating illumination mounted to the housing (11) above the fan blades (15), and a shield (14) for insuring that substantially all illumination from the light source (13) is projected away from the fan blades (15). A single switching control (45) is provided for operating both a motor speed control switch (41) and a light control switch (42). The switching control (45) extends beneath fan motor (12) and fan blades (15) to permit safe and convenient operation by the user.

11 Claims, 1 Drawing Figure

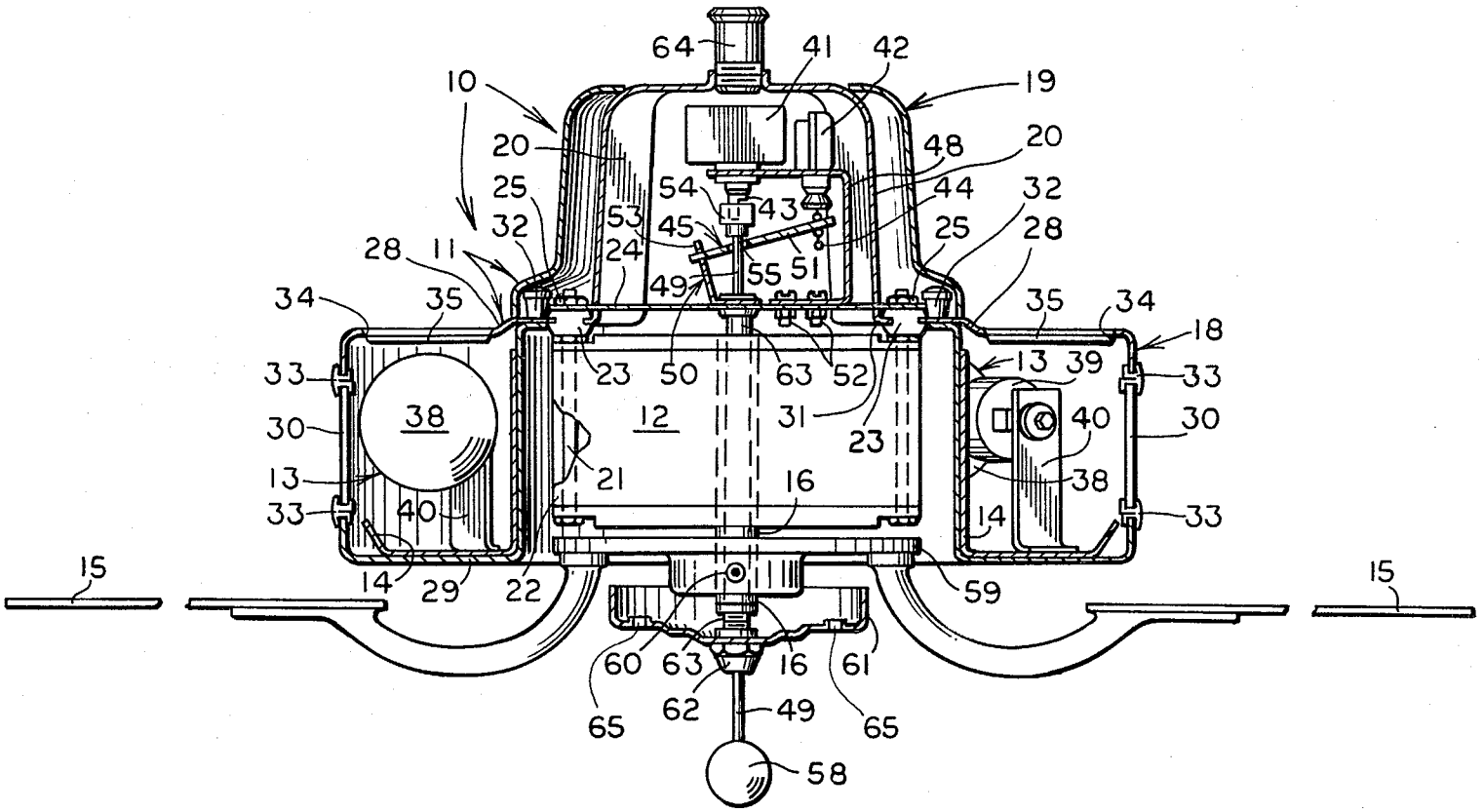
15
18
33
30
33
34
39
40
38
35
13
14
59
19
20
32
28
48
44
25
42
23
52
31
65
61
41
43
51
55
63
16
16
49
58
64
54
45
49
50
12
62
63
53
24
23
21
60
65
20
25
32
22
10
11
35
38
40
29
28
14
34
33
30
13
33
15

COMBINED CEILING MOUNTED FAN AND LIGHTING FIXTURE

TECHNICAL FIELD

The present invention relates to ceiling mounted combination fan and light units. More particularly, the present invention pertains to a decorative ceiling mounted combination fan and lighting fixture in which large blades rotate at relatively slow speeds to quietly move large volumes of air while simultaneously providing illumination.

BACKGROUND ART

Ceiling mounted fan and light units have long been used, usually in a highly ornamental manner, to provide a gently cooling breeze and useful illumination. The earliest units, exemplified by U.S. Pat. Nos. 585,250 (FIG. 1); 623,801; 2,079,942; and 2,119,398 mounted the light source below the fan motor and rotating fan blades. Particularly when placed in rooms having lower ceiling heights, this resulted in a large fixture height limiting useable headroom and produced uncomfortably harsh, direct ambient lighting. Additionally, such configurations resulted in deleterious disturbances to air flow in the vicinity of the light source.

More recently designers of ceiling mounted fan and light units have preferred to mount the light source above the fan motor and fan blades. However, with the light source mounted above the fan blades, an immensely distracting flickering of the illumination occurs as the light is periodically blocked by and then passes between the rotating fan blades.

Attempts to overcome this flickering effect have centered about relocating the light source to permit its illumination to pass downward other than through the area occupied by the fan blades. For example, in U.S. Pat. No. 4,064,427 a safety guard surrounds the perimeter of the fan blade tips and a plurality of light fixtures are mounted thereto in a plane slightly above that of the fan blades. Similarly in U.S. Pat. No. 2,547,896 a circular fluorescent lamp having a larger diameter than that of the fan blades is mounted in a plane above the fan blades. U.S. Pat. No. 2,581,185 discloses a combination light fixture and fan in which the fan blades and a circular fluorescent lamp are substantially co-planar, the lamp surrounding the fan blades.

I am aware of only one other approach utilized to eliminate the flickering effect. In U.S. Pat. No. 2,201,153 a light bulb is mounted directly above fan blades that are transparent so as to preclude periodic interruption of the downward travel of light. This design still produces flickering because of changes in the optical density between the air and the fan blade material.

Neither the approach of utilizing transparent fan blades nor that of repositioning the light source remedy the difficulties induced by direct lighting, particularly in a manner that provides for a compact unit. I have found that by mounting the light source directly above the fan blades and surrounding the fan motor, and by utilizing a shield to direct all light other than downwardly through the fan blades, a compact ceiling mounted combination fan and light fixture is produced that furnishes pleasingly soft, indirect lighting. I have also found further operator convenience and space savings achieved through the use of a single control rod coaxial with the fan motor shaft for controlling both fan and light operation. Heretofore these controls have been separate and, as respectively shown in U.S. Pat. Nos. 4,073,598 and 2,581,185, mounted either beneath or outside the perimiter of the fan motor and fan blades.

DISCLOSURE OF INVENTION

It is, therefore, an object of the invention to provide a combined ceiling mounted fan and lighting fixture that furnishes pleasingly soft, indirect lighting, without any flickering effect.

It is another object of the invention to provide a combined ceiling mounted fan and lighting fixture as set forth above, that is compact and has both minimal height and a housing with minimal width.

It is still another object of the invention to provide a combined ceiling mounted fan and lighting fixture, as set forth above, wherein the light source is situated above the fan blades and mounted to the housing, and a shield insures that substantially all illumination from the light source is projected away from the fan blades.

It is yet another object of the invention to provide a combined ceiling mounted fan and lighting fixture, as set forth above, wherein a single conveniently located switching control operates both the motor and the fan.

It is a further object of the invention to provide a combined ceiling mounted fan and lighting fixture, as set forth above, wherein decorative transparent materials such as glass may be mounted so as to be illuminated by the indirect lighting.

These and other objects and advantages of the present invention over existing prior art forms will become more apparent and fully understood from the following description in conjunction with the accompanying drawings.

In general, in accordance with the concept of the present invention a combined ceiling mounted fan and lighting fixture having a plurality of fan blades includes a housing capable of being mounted to the ceiling, a motor for rotating the fan blades, the motor mounted within the housing and having a rotating shaft, a light source for generating illumination mounted to the housing above the fan blades, and means for insuring that substantially all illumination from the light source is projected away from the fan blades.

BRIEF DESCRIPTION OF THE DRAWING

The sold FIGURE depicts a vertical section of an exemplary combined ceiling mounted fan and lighting fixture according to the concept of the present invention.

PREFERRED EMBODIMENT FOR CARRYING OUT THE INVENTION

The FIGURE illustrates a combined ceiling mounted fan and lighting fixture, generally indicated by the numeral 10, and hereafter referred to as "fan and light fixture 10," which embodies the teachings of the present invention. Fan and light fixture 10 includes a housing indicated generally by the numeral 11, fan motor 12, light source 13, light shield 14 and a plurality of fan blades 15. For reasons which shall be more readily apparent hereinafter, fan motor 12 may be any suitable conventional fan motor but must have a hollow cylindrical shaft 16.

Housing 11 includes a substantially toroidally shaped chamber 18 and substantially dome shaped compartment 19, the latter of which has integral therewith a multiple arm bracket 20 for support of fan motor 12. Motor carriage bolts 21 extend through motor casing 22, vibration-limiting rubber gromets 23, the arms of bracket 20, and a circular bottom plate 24 and are secured by nuts 25.

Toroidal chamber 18 is defined by an annular top panel 28, a lower panel 29 and a decorative glass side panel 30. Top panel 28 includes a plurality of eyelets 31 around its inner periphery into which grommets 23 are placed and which by interference fit maintain top panel 28 in fixed spatial relation to the other portions of housing 11. Lower panel 29 is formed into an annular "L" to act as both the inside and bottom surface of toroidal chamber 18. A flange is provided at the top of the inside surface of lower panel 29 to permit removable connection to top panel 28 by any suitable means, such as by thumbhead screws 32. The ends of top panel 28 and lower panel 29 not connected by thumbhead screws 32 are formed at right angles into the same vertical plane so as to provide the outside surface of toroidal chamber 18. Decorative glass side panels 30 are inserted in this vertical plane between the ends of top panel 28 and lower panel 29 by any conventional means such as retainer clips 33. The efficiency of the fan and light fixture 10 as a source of indirect illumination is greatly enhanced where an annular opening 34 is made in top panel 28, permitting light to be directed directly toward the ceiling. Where desired the opening may be given a beveled edge and any transparent or translucent material (as glass 35) may be placed in opening 34 for further decorative effect and softening of the original illumination.

Toroidal chamber 18 houses light source 13 and light shield 14. Light shield 14, which may be any opaque material but is also preferably reflective (such as polished aluminum), is secured by adhesion or other well-known technique to the inside surface of lower panel 29, thereby insuring that no illumination is directed toward the fan motor 12 or the fan blades 15. The end of light shield 14 radially outermost from fan motor 12 should be angled upward such that any light that would otherwise reflect from side to side in toroidal chamber 18 is directed to exit through decorative glass 30 and 35. Although any type of lighting may be utilized with the present invention, a plurality of incandescent lamps 38 are shown in the drawing mounted in sockets 39 attached to brackets 40 that are in turn fixed to lower panel 29 through light shield 14 by any acceptable means as welding.

Compartment 19 houses all the electric control components for fan and light fixture 10. These components include a motor speed control switch 41 and a light control switch 42, and may further include a capacitor (not shown) to improve the operating efficiency of fan motor 12 and a motor reversing switch to reverse the rotation direction of fan blades 15. Motor speed control switch 41 may be any conventional motor control permitting variable speed operation as its shaft 43 is rotated from an "off" position. Shaft 43 of motor speed control switch 41 must be capable of axial movement without adverse effect. Light control switch 42 may be any conventional pull-chain switch, and may be either of the type known as "2-way" whereby all lamps 38 operate simultaneously in parallel, or of such type as to permit selective operation of each lamp 38 by successive pulling operations of pull-chain 44. The skilled artisan will appreciate that both motor speed control switch 41 and light control switch 42 may be physically contained within the same housing so long as the necessary functions are maintained separate.

Both motor speed control switch 41 and light control switch 42 are operated by a single switching control 45 that includes "U"-shaped bracket 48, a small diameter control rod 49, hinge support 50 and control linkage arm 51. Motor speed control switch 41 and light control switch 42 are both mounted upon one side of "U"-shaped bracket 48, the opposite side of which bracket is in turn secured to bottom plate 24 by screws 52 or the like. Hinge support 50 is an angle support mounted to bottom plate 24 and whose upwardly pointed back 53 provides a freely pivotable mounting for one end of control linkage arm 51. Motor speed control switch 41 is mounted to bracket 48 with its shaft axially aligned with the shaft of fan motor 12. Control rod 49 is connected at one end to the shaft 43 of motor speed control switch 41 by a coupling 54, passes through a slot 55 in control linkage arm 51 of a width smaller than the diameter of coupling 54, and extends coaxially through the hollow shaft 16 of fan motor 12 to a point below fan blades 15 for safe access by the user. A control knob 58 may be provided at the lower end of control rod 49 for appropriate decorative effect and ease of operation. The end of control linkage arm 51 opposite that pivotably mounted within hinge support 50 is bifurcated and the pull-chain of light control switch 42 wedged therebetween.

Fan blades 15 are mounted directly to a flywheel hub 59 which in turn is secured to shaft 16 of fan motor 12 by set screw 60. In order to discretely cover shaft 16 and the greatest possible portion of flywheel hub 59, trim cup 61 is furnished secured by hex nut 62 to a threaded hollow support rod 63 coaxially interposed between control rod 49 and fan motor 12 shaft 16 and affixed to bottom plate 24 directly beneath hinge support 50. Final positive connection of fan and light fixture 10 to the ceiling may be made with roll pin 64 which threadably engages multiple arm bracket 20.

The operation of fan and light fixture 10 is quite straightforward. Rotation of control knob 58 similarly rotates shaft 43 of motor speed control switch 41 controlling the rotational velocity of fan motor 12. Pulling control knob 58 downward similarly pulls downward control rod 49 and coupling 54. Since the width of slot 55 in control linkage arm 51 is smaller than the diameter of coupling 54, coupling 54 will force control linkage arm 51 downward causing it to rotate about hinge support 50 and pull downward the light control switch 41 pullchain. Removal of thumbhead screws 32 will result in the removal of top panel 28, lower panel 29 and decorative glass side panel 30 whereupon any defective lamp 38 may be replaced.

It should be appreciated that the disclosed preferred embodiment may be readily modified to provide for a source of direct lighting in addition to the source of indirect lighting detailed hereinabove. In particular, by placing a plurality of threaded holes 65 in the bottom of trim cup 61, a conventional light fixture may be mounted thereto beneath fan blades 15. Electric power could be brought to this fixture from compartment 19 through threaded rod 63.

Inasmuch as the present invention is subject to many variations, modifications and changes in detail, a number of which have been expressly stated herein, it is intended that all matter described throughout this entire specification or shown in the accompanying drawings be interpreted as illustrative and not in a limiting sense.

It should thus be evident that a device constructed according to the concept of the present invention, and reasonably equivalent thereto, will accomplish the objects of the present invention and otherwise substantially improve the art of combined ceiling mounted fan and lighting fixtures.

I claim:

1. A combined ceiling mounted fan and lighting fixture having a plurality of fan blades, comprising:
- a housing capable of being mounted to the ceiling and including chamber means and compartment means;
- motor means for rotating the fan blades, said motor means mounted within said housing and having a rotating shaft in the form of a hollow cylinder;
- lighting means for generating illumination mounted within said chamber means of said housing and above said fan blades;
- shield means for insuring that substantially all illumination from said lighting means is projected away from the fan blades;
- light control means mounted within said compartment means for controlling the operation of said lighting means;
- motor control means mounted within said compartment means for controlling the rotational speed of the fan blades; and,
- switching control means for selectively actuating said light control means and said motor control means, said switching control means being coaxial with said shaft of said motor means and extending below said housing and the fan blades and including control rod means coupled to said motor control means and passing coaxially through said shaft in said motor means to a point below said housing and the fan blades, rotation of said control rod means operating said motor control means so as to control the rotation speed of the motor and fan blades.

2. A combined ceiling mounted fan and lighting fixture, as set forth in claim 1, wherein said motor means is mounted beneath said compartment means and said chamber means annularly surrounds said motor means.

3. A combined ceiling mounted fan and lighting fixture as set forth in claim 1, wherein said compartment means is substantially dome shaped and includes support bracket means to which said motor means is secured.

4. A combined ceiling mounted fan and lighting fixture, as set forth in claim 1, said switching control means including a control linkage arm one end of which is operatively connected to said light control means, and further including angle bracket means fixed within said compartment means for providing a pivot point for the end of said control linkage arm opposite that operatively connected to said light control means, said control rod means passing through said control linkage arm such that a downward force upon said control rod means pivots said control linkage arm, operating said light control means so as to control the operation of said lighting means.

5. A combined ceiling mounted fan and lighting fixture, having a plurality of fan blades, comprising:
- a housing capable of being mounted to the ceiling;
- motor means for rotating the fan blades, said motor means mounted within said housing and having a rotating shaft;
- lighting means for generating illumination mounted to said housing above said fan blades;
- shield means for insuring that substantially all illumination from said lighting means is projected away from the fan blades;
- light control means for controlling the operation of said lighting means; and,
- motor control means for controlling the rotational speed of the fan blades, said housing including chamber means for housing said lighting means and compartment means for housing said light control means and said motor control means, said motor means mounted beneath said compartment means and said chamber means annularly surrounding said motor means, said chamber means substantially toroidally shaped and including top panel means and lower panel means both removably secured to said compartment means, said chamber means further including decorative side panel means for permitting said illumination to exit from said chamber means therethrough.

6. A combined ceiling mounted fan and lighting fixture, as set forth in claim 5, wherein said top panel means includes decorative top panel means for permitting said illumination to exit from said chamber means therethrough.

7. A combined ceiling mounted fan and lighting fixture, as set forth in claim 5, wherein said shield means is an opaque material mounted inside said chamber means to said lower panel means.

8. A combined ceiling mounted fan and lighting fixture, as set forth in claim 7, wherein said shield means is a reflective material.

9. A combined ceiling mounted fan and lighting fixture, as set forth in claim 8, said lighting means including a plurality of lamp means for generating incandescent light, each said lamp means mounted upon said lower panel means.

10. A combined ceiling mounted fan and lighting fixture, having a plurality of fan blades, comprising:
- a housing capable of being mounted to the ceiling and including chamber means and compartment means;
- motor means for rotating the fan blades, said motor means mounted within said housing and having a rotating shaft;
- lighting means for generating illumination, said chamber means housing said lighting means;
- light control means for controlling the operation of said lighting means;
- motor control means for controlling the rotational speed of the fan blades, said compartment means housing
- said light control means and said motor control means; and,
  - switching control means for selectively actuating both said light control means and said motor control means, said switching control means coaxial with said shaft of said motor means and extending below said housing and the fan blades, said shaft in said motor means being a hollow cylinder, said switching control means including control rod means and passing coaxially through said shaft in said motor means to a point below said housing and the fan blades, rotation of said control rod means operating said motor control means so as to control the rotation speed of the motor and fan blades.

11. A combined ceiling mounted fan and lighting fixture, as set forth in claim 10, said switching control means including a control linkage arm one of which is operatively connected to said light control means, and further including angle bracket means fixed within said compartment means for providing a pivot point for the end of said control linkage arm opposite that operatively connected to said light control means, said control rod means passing through said control linkage arm such that a downward force upon said control rod means pivots said control linkage arm, operating said light control means so as to control the operation of said lighting means.

* * * * *